United States Patent [19]

Takemura

[11] 4,345,118

[45] Aug. 17, 1982

[54] QUARTZ TUNING FORK ELECTRO-ACOUSTIC TRANSDUCER

[75] Inventor: Seinosuke Takemura, Chitoseshi, Japan

[73] Assignee: Daiwa Shinku Corporation, Hyogo, Japan

[21] Appl. No.: 161,152

[22] Filed: Jun. 19, 1980

[30] Foreign Application Priority Data

Jun. 22, 1979 [JP] Japan ..... 54-79497
Jun. 22, 1979 [JP] Japan ..... 54-79498
Jun. 22, 1979 [JP] Japan ..... 54-79499

[51] Int. Cl.[3] ..... H04R 17/00
[52] U.S. Cl. ..... 179/110 A
[58] Field of Search ..... 179/110 A

[56] References Cited

U.S. PATENT DOCUMENTS 1,459,803 6/1923 Steurer ..... 179/180
1,622,150 3/1927 Jones ..... 179/180
1,636,921 7/1927 Nicolson ..... 179/110 A
1,753,312 4/1930 Nicolson ..... 179/110 A

*Primary Examiner*—George G. Stellar
*Attorney, Agent, or Firm*—Koda and Androlia

[57] ABSTRACT

An acousto-electronic transducer includes an oscillator of quartz located in a sealed casing whose ceiling is constituted by a vibrant film, wherein the oscillator is connected to a pair of electrodes, and wherein the oscillator is connected to the vibrant film.

5 Claims, 17 Drawing Figures

QUARTZ TUNING FORK ELECTRO-ACOUSTIC TRANSDUCER

BACKGROUND OF THE INVENTION

1. Field of the Invention

The present invention relates to an acousto-electronic transducer especially adapted for use as an extremely small type, and more particularly, to an acousto-electronic transducer including an oscillator of quartz specially arranged so as to utilize its superior frequency characteristic.

2. Description of the Prior Art

In principle, the conventional microphones can be classified into a carbon type, an electro-magnetic type, and a dynamic type. In addition, there is another called a crystal type in which a substance having piezoelectric properties, such as Rochelle salt, is employed, and more recently there is a further type called a condenser type in which changes in electric capacity are utilized.

However, regardless of the common knowledge that quartz has superior electrical and acoustic properties it has not been employed for a microphone, because of its limited production and the resulting high price. The price is particularly so high that it is generally accepted as a jewery. In addition, when quartz is used for frequency control a thin plate must be appropriately cut from quartz crystals, which means that a usable portion of quartz is small, and an oscillator of quartz will become very expensive.

The known quartz oscillators have been used only for generating high frequency, but its resonance frequency is outside the audiofrequency domain.

Recently, however, the technology of man-made quartz has made remarkable progress, and the price has been reduced because of its mass-production. In addition, by virtue of the development of a tuning fork oscillator of quartz its resonance frequency has reached the supersonic wave domain, which is close to the audiofrequency domain. In particular, the development of crystal-controlled watches has paved the way to the low-priced mass-production of tiny tuning fork oscillators of quartz whose resonance frequency is for example 32.76 kHZ.

The present invention is directed to utilize the superior qualities of quartz as an acousto material, and has for its object to provide a small-size acousto-transducer with high articulation and fidelity and with high stability against any changes in temperature, humidity and pressure.

SUMMARY OF THE INVENTION

According to one advantageous aspect of the present invention an acousto-electronic transducer includes an oscillator of quartz located in a sealed casing whose ceiling is constituted by a vibrant film, wherein the oscillator is connected to a pair of electrodes, and wherein the oscillator is connected to the vibrant film.

According to another advantageous aspect of the present invention an acousto-electronic transducer includes an oscillator of quartz located in a sealed casing whose ceiling and bottom are constituted by vibrant films each having different vibrating properties, the oscillator being connected to a pair of electrodes, wherein the oscillator is connected to each vibrant film in the ceiling and bottom of the casing.

According to a further advantageous aspect of the present invention an acousto-electronic transducer includes an oscillator of quartz located in a sealed casing whose ceiling or bottom is constituted by a vibrant film with a frequency adjuster placed thereon, wherein the oscillator is connected to the vibrant film, the oscillator being connected to a pair of electrodes.

DETAILED DESCRIPTION OF THE INVENTION

Figure 1:
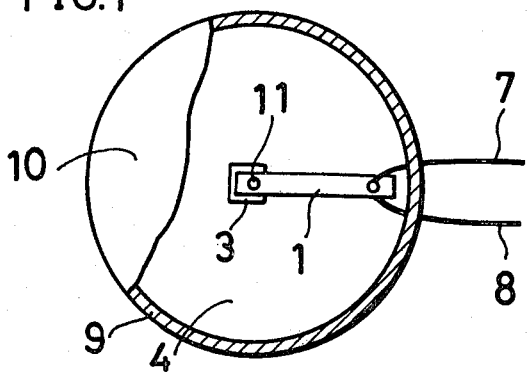
FIG. 1 is a plan view, partly broken, of an oscillator unit in accordance with the present invention.
Figure 2:
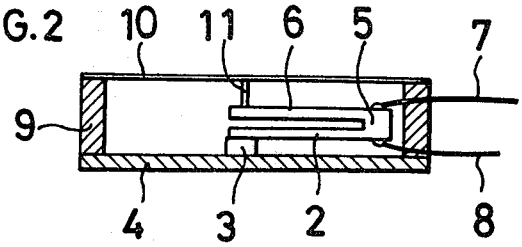
FIG. 2 is a vertical cross-section through the oscillator unit in FIG. 1.

In common with all the embodiments illustrated in the drawings an oscillator of quartz is housed in a sealed casing, and these two members will be jointly referred to as an oscillator unit.

Referring to FIGS. 1 to 4, a tuning fork oscillator 1 of quartz has two tines 2 and 6, wherein the tine 2 is fastened at its tip end to the bottom 4 of a casing through an insulator member 3 while its shank 5 and the other tines 6 are kept free therefrom so as to allow the oscillator to oscillate. A pair of lead lines 7 and 8 are led from the shank 5 of the oscillator. The casing has ring-shaped side walls 9, wherein the ceiling of the casing is constituted a vibrant film 10 as of polyester. The vibrant film 10 and the oscillating tine 6 are connected by a thin needle 11, wherein one end of the needle is fastened to the center of the film while the other end thereof is fastened to the tip end of the tine 6. The oscillator 1 and the inside walls of the casing are totally or partially coated with an electrically conductive substance. The lead line 7 is electrically connected to the conductor coating on the oscillator 1, and is earthed to the ground. The lead line 8 is insulated by the insulator member 3 from the conductor coating on the inside walls of the casing, and is used as an input terminal.

Figure 13:
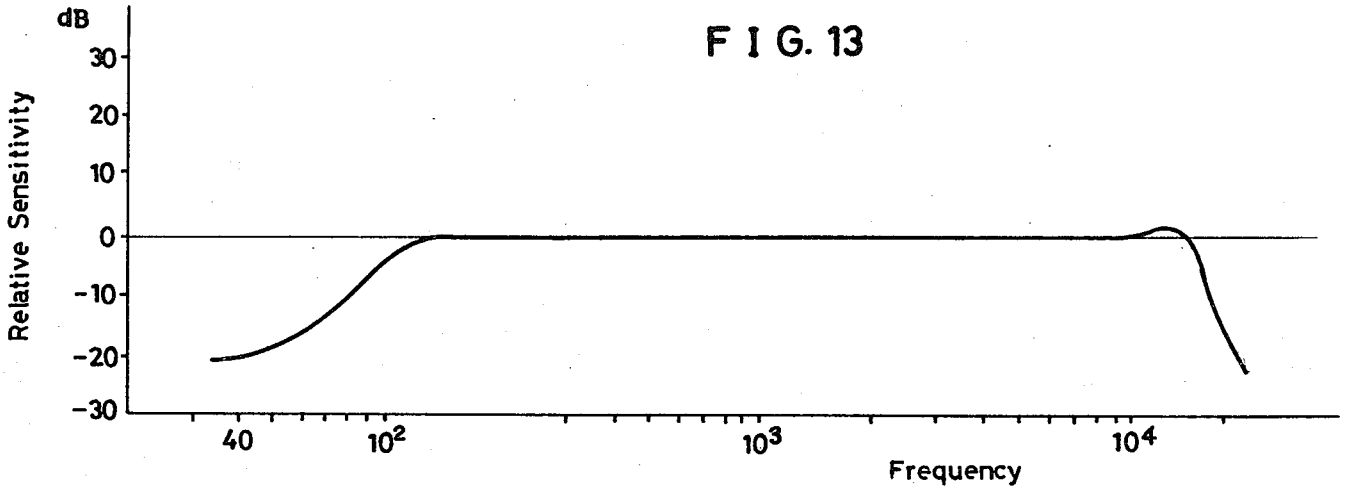
FIG. 13 is a graph showing the frequency/sensitivity characteristic for the embodiment in FIGS. 1 and 2.

In an experiment an oscillator of 6 mm (L)×1.6 mm (W)×0.5 mm (T) was used in a microphone having a diaphragm of 12 mm (Dia.)×3.8 mm (T), and the frequency/sensitivity characteristic obtained are shown in FIG. 13.

Figure 3:
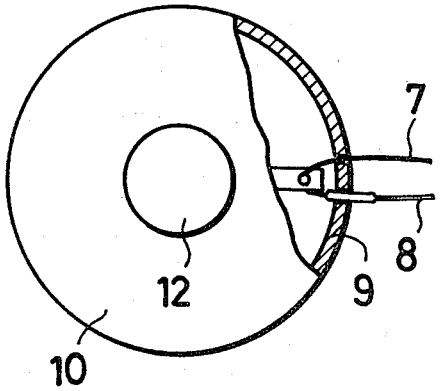
FIG. 3 is a plan view of a modified version of the oscillator unit in accordance with the present invention.
Figure 4:
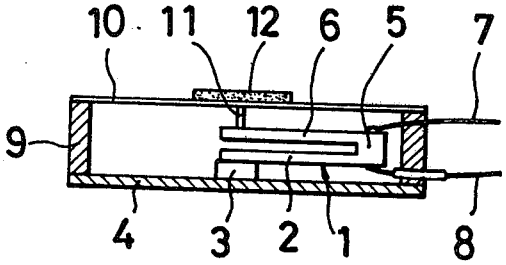
FIG. 4 is a vertical cross-section through the oscillator unit in FIG. 3.

In order to control the frequency/sensitivity characteristic of acousto-electronic transducers, a disc-shaped adjuster 12 is adhered to the vibrant film 10 concentrically thereof as shown in FIGS. 3 and 4. When the adjuster can be made of rubber, soft plastics or any other resilient material, it has been found that the upper limit of the frequency domain shifts to the low frequency domain on the characteristic curve, and that the sensitivity attains its peak point within the upper limit domain.

Figure 14:
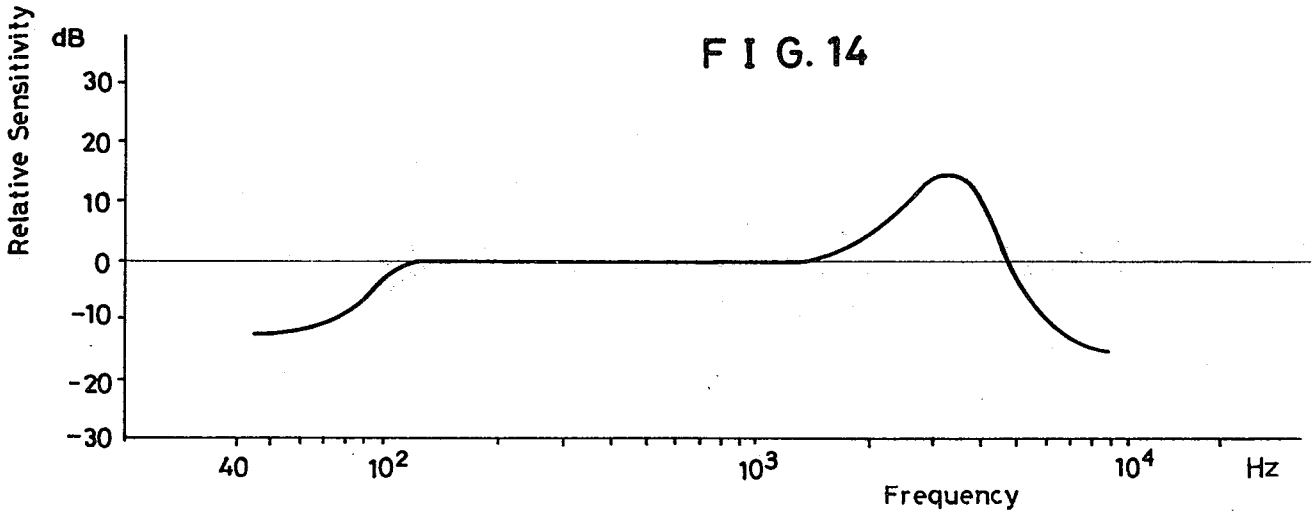
FIGS. 14 and 15 are graphs showing the frequency/sensitivity characteristic for the embodiment in FIGS. 3 and 4.

After the data in FIG. 13 have been obtained the same microphone was tested with respect to its frequency/sensitivity characteristic by adhering a rubber piece of 7 mm (Dia.)×0.5 mm (T) to the vibrant film of the microphone. The resulting data are shown in FIG. 14. It has been found that when a metal with high density, such as lead and cupper, is used for the adjuster 12, the sensitivity characteristic graph has a sharp peak point in the particular frequency in accordance with the mass of the metal.

Figure 15:
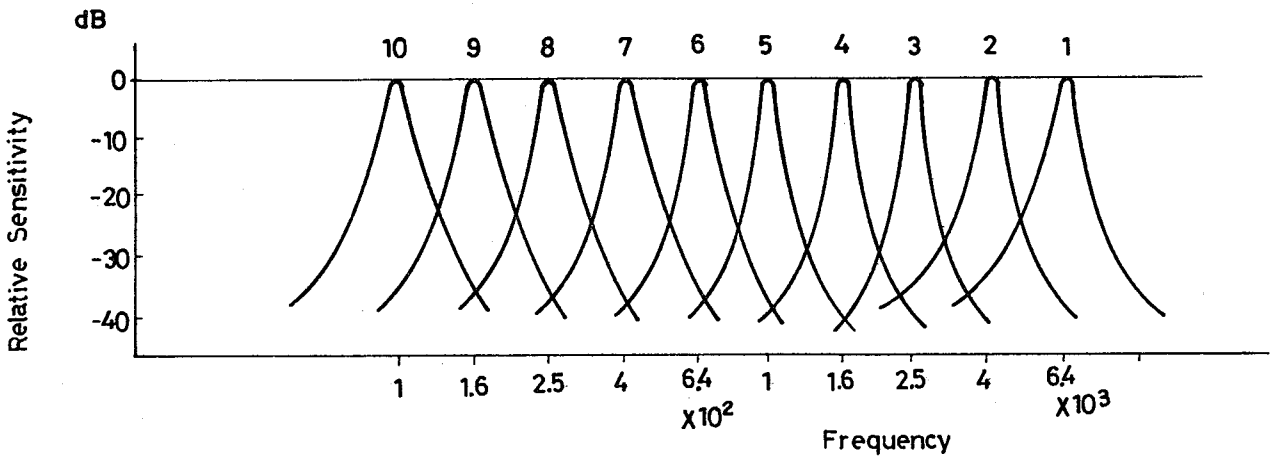

The microphone used for FIG. 13 was tested by adhering an adjuster of lead to the vibrant film concentrically thereof, and the resulting data are shown in FIG. 15. As shown therein, the sensitivity characteristic has several sharp peak points. As the mass of the metal increases, the peak points shift from Graph (1) to Graph (10), that is, from the high frequency domain to the low frequency domain. It will be understood from the graphs that it is possible to control the frequency at peak in accordance with the value of mass of the adjuster 12. Graph (1) was obtained when a disc-shaped lead of 0.2 mm (T)×3 mm (Dia.) was used for the adjuster, and Graph (10) was obtained when a disc-shaped lead of 5.0 mm (T)×10 mm (Dia.) was used.

Figure 5:
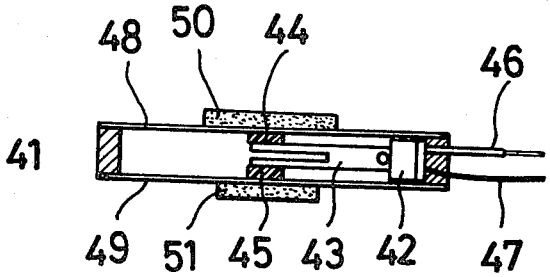
FIG. 5 is a cross-section through another modified version of the oscillator unit in accordance with the present invention.

Referring to FIG. 5, a modified version of the embodiment will be explained:

In this embodiment the bottom and ceiling of the casing are constituted by vibrant films 49 and 48, respectively, and the side wall 41 thereof is made of aluminium or brass. A tuning fork oscillator 43 is supported on a support 42 fastened to the side wall 41. Each tine of the oscillator is connected to the vibrant films 48 and 49 through intermediate members 44 and 45 of rubber or plastics, respectively. Each film 48 and 49 is respectively provided with adjusters 50 and 51 concentrically thereof, wherein the two adjusters are different in size as clearly shown in FIG. 5. The vibrant films 48 and 49 can be made of plastics, such as polyester. The tuning fork oscillator 43 has a pair of lead lines 46 and 47 leading from its shank. The vibrant films are coated with an electrically conductive substance on their both sides or on their one side, or the side wall 41 and the vibrant films 48 and 49 together can be coated therewith.

Figure 16:
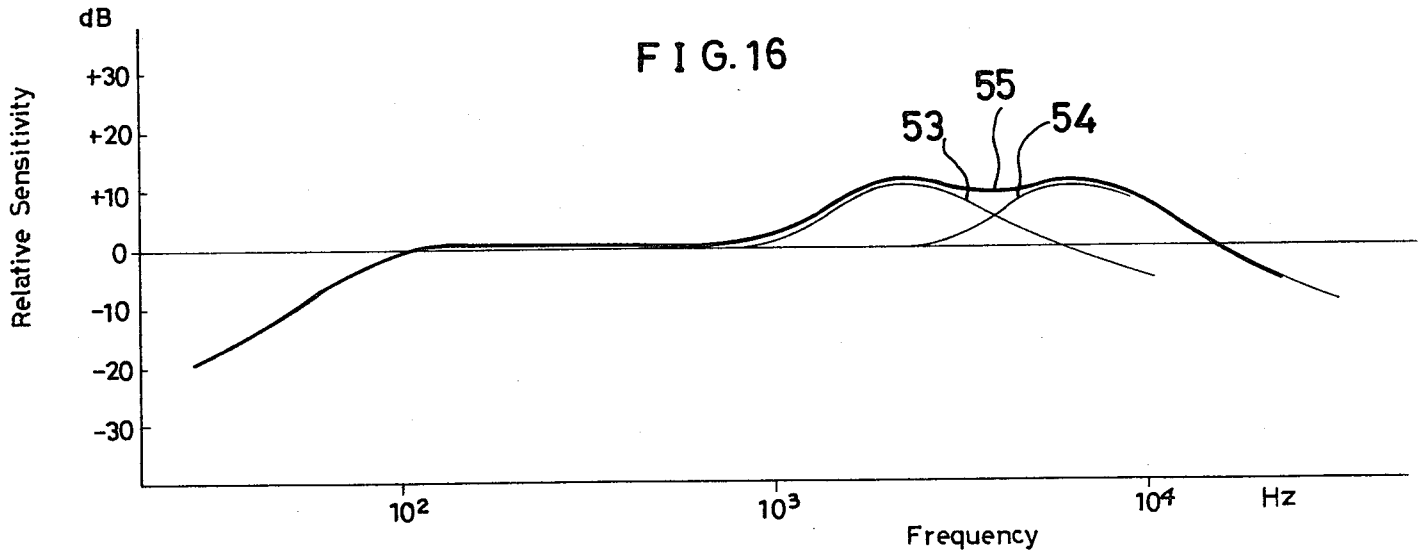
FIG. 16 is graphs showing the frequency/sensitivity characteristic for the embodiment in FIG. 5.

The adjusters 50 and 51 are disc-shaped, made of rubber or soft plastics or any other resilient material. When the two adjusters 50 and 51 are made of the same material to the same thickness, the resonant frequency tends to shift toward the lower domain in accordance with the increase in its diameter. The data obtained under this arrangement are shown in FIG. 16, in which three curves 53, 54 and 55 are depicted. The curve 53 was obtained when the vibrant film 48 was caused to oscillate with the adjuster 50 thereon while the other vibrant film 49 has no adjuster placed thereon. The peak point was attained at 2200 Hz. The curve 54 was obtained when the vibrant film 49 was caused to oscillate with the adjuster 51 thereon while the vibrant film 48 has no adjuster placed thereon. The peak point was attained at 6300 Hz. The curve 55 was obtained when the vibrant films 48 and 49 were caused to oscillate with the respective adjusters 50 and 51 thereon. It will be appreciated that the curve 55 has a flat portion in the area defined by the curves 53 and 54.

Figure 6:
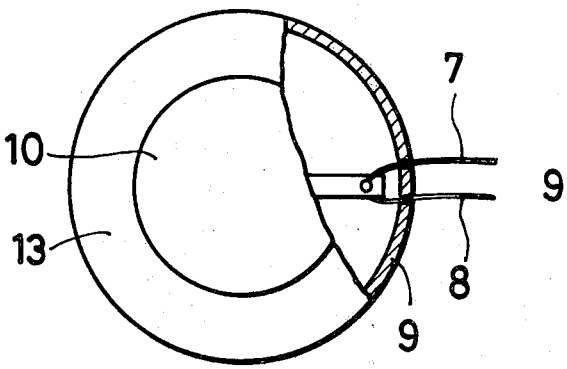
FIG. 6 is a plan view, partly broken, of a further modified version of the oscillator unit in accordance with the present invention.
Figure 7:
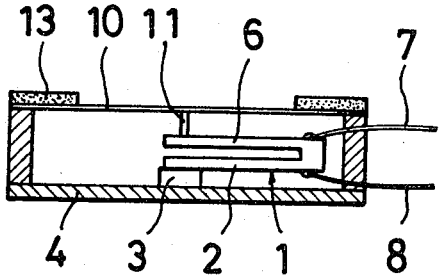
FIG. 7 is a vertical cross-section through the oscillator unit in FIG. 6.
Figure 17:
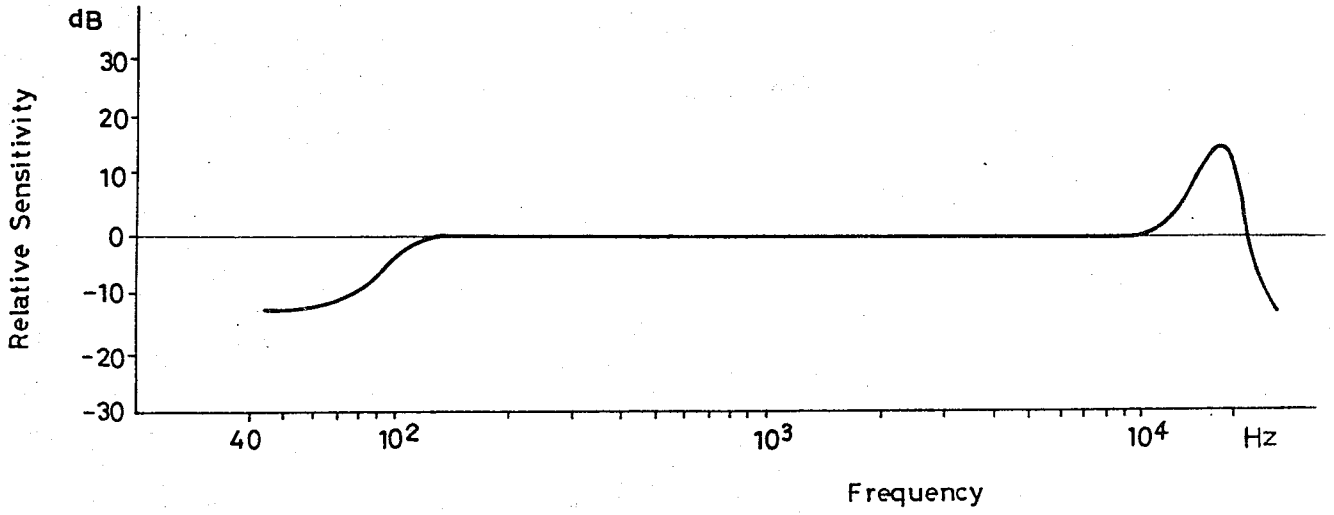
FIG. 17 is a graph showing the frequency/sensitivity characteristic for the embodiment in FIGS. 6 and 7.

Referring now to FIGS. 6 and 7, a further modified version of the oscillator unit will be explained:

In this embodiment an adjuster 13 is ring-shaped, and is placed along the peripheral edge of the vibrant film 10. The ring-shaped adjuster 13 is likewise made of a resilient material, such as rubber. It has been found that the upper limit of the frequency domain tends to extend to the high frequency area. An experiment was conducted with the use of the same microphone used for FIG. 13, wherein the ring-shaped adjuster 13 employed was rubber of 12 mm (outside dia.)×6 mm (inside dia.)×0.5 mm (T). The resulting data are shown in FIG. 17.

Figure 8:
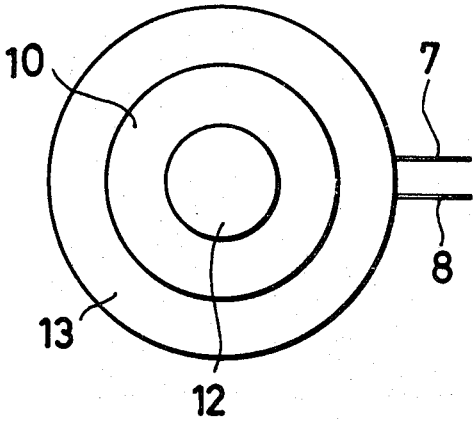
FIG. 8 is a plan view of a modified version of the embodiment illustrated in FIGS. 6 and 7.

The embodiment in FIG. 6 can be further modified as shown in FIG. 8, by combining the two embodiments in FIGS. 3 and 6. This version is featured by two ring-shaped adjusters 12 and 13 both placed concentrically of the vibrant film 10. This embodiment is advantageous in that the shape and material of the two adjusters can be different from each other. Preferably, however, the upper adjuster 12 may be made of either resilient or solid material, such as either rubber or lead. In addition, the upper adjuster can take any shape, such as circular and rectangular. With these two adjusters the vibrant film 10 substantially has an increased mass. As a result, regardless of its small size the microphone can have an improved sensitivity of the lower portion of the frequency domain. This embodiment has an advantage that it provides a wide range of choice in controlling the sensitivity characteristic as variously as desired by selecting the material, the size and shape of these adjusters.

Figure 9:
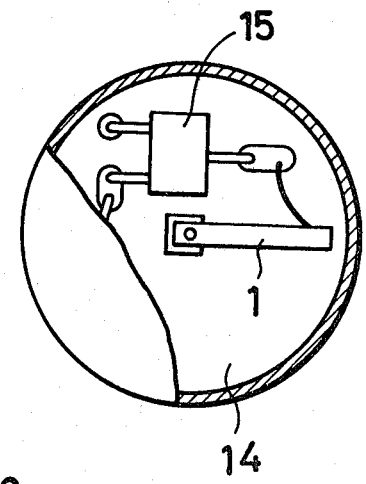
FIG. 9 is a plan view, partly broken, of a still further modified version of the oscillator unit in accordance with the present invention.
Figure 10:
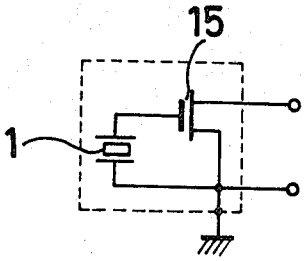
FIG. 10 is an electric diagram used in the embodiment in FIG. 9.

The embodiment in FIG. 9 is a further modified version, in which a field effect transistor (FET) 15 is additionally provided. Furthermore, the bottom 14 of the casing is made of a printed circuit plate. The FET is designed so as to amplify the e.m.f. of the oscillator 1. The electrodes of the oscillator 1 and the FET 15 are electrically connected within the casing, wherein the output of the FET is led out by a lead line. The printed circuit layer on the bottom plate 14 can be utilized as part of the aforementioned electrostatic shield, thereby eliminating the necessity of providing a special conductive coating on the bottom plate. Electrical signals at the electrodes of the oscillator 1 are applied to the gate of the FET 15 as shown in FIG. 10 converting high impedance to low impedance. The electrical connection is protected against the external magnetic field by virtue of the electrostatic shield. The amplified signals are transmitted to outside through the lead line. As a result, the SN ratio of a microphone immensely improves.

Figure 11:
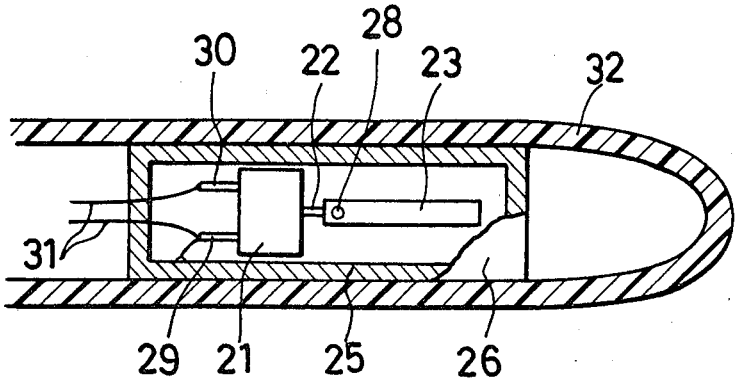
FIG. 11 is a cross-section through a microphone including an oscillator in accordance with the present invention.
Figure 12:
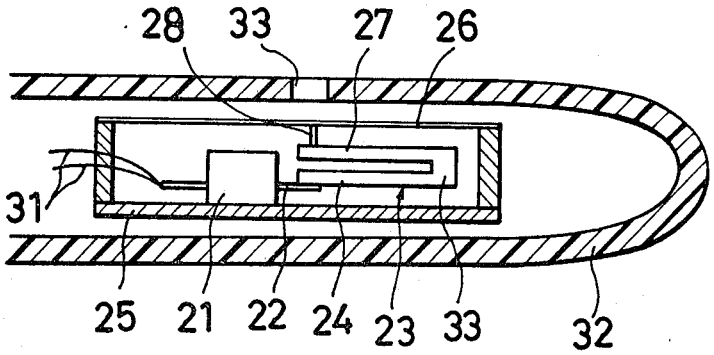
FIG. 12 is a cross-sectional side view of the microphone in FIG. 11.

FIGS. 11 and 12 show a microphone including the embodiments described above, wherein FIG. 11 is a front view thereof while FIG. 12 is a side view thereof:

One of the tines of a tuning fork oscillator of quartz 23 is connected to the gate 22 of an FET 21, wherein the tine 24 is preferably soldered flatly thereto. The FET 21 connected to the oscillator 23 is fastened to the bottom of a casing 25 whose ceiling is constituted by a vibrant film 26, wherein the film 26 and the tine 27 of the oscillator are connected by a needle 28. The inside wall of the casing is provided with an electrically conductive coating for the aforementioned electrostatic shield, to which a drain terminal 29 of the FET 21 is connected. From the drain terminal 29 and a source terminal 30 of the FET a lead line 31 is led out. Reference numeral 32 designates an outer casing having an aperture 33 which is produced above vibrant film 26 so as to permit of passage of sound wave. In the illustrated embodiment the inside diameter of the outer casing 32 is 5 mm.

The shape of the oscillator is not limited to the fork shape, but it can be circular, rectangular, square, cylindrical, band-shaped or any other desired shapes, and the casing can be circular, rectangular or oval, which means that the shape of the vibrant film can take various shapes accordingly.

What is claimed is:

1. An acousto-electronic transducer including an oscillator of quartz, which comprises:

said oscillator being a tuning fork oscillator having a pair of tines and a shank portion;

said oscillator being located in a sealed casing;

said casing having a ceiling of a vibrant film;

one of said tines of said oscillator being fastened to the bottom of said casing while the other tine is connected to said vibrant film of said casing; and said oscillator including a pair of electrodes.

2. An acousto-electronic transducer as set forth in claim 1, further comprising an adjuster placed on said vibrant film concentrically of said casing, said adjuster being adapted to control frequency/sensitivity characteristic of said acousto-electronic transducer.

3. An acousto-electronic transducer including an oscillator of quartz, which comprises:

said oscillator being a tuning fork oscillator having a pair of tines and a shank portion;

said oscillator being located in a sealed casing whose ceiling and bottom are both made of vibrant films, wherein said two vibrant films have different natural frequencies;

said oscillator being fastened to said casing at its shank portion;

one of said tines being connected to said vibrant film in said ceiling; and the other tine being connected to said vibrant film in said bottom.

4. An acousto-electronic transducer as set forth in claim 3, further comprising an electric element for converting high impedance into low impedance, said element being located in said casing.

5. An acousto-electronic transducer as set forth in any one of claims 2 or 3, further comprising an adjuster placed along the peripheral edges of said vibrant film, said adjuster being adapted to control frequency/sensitivity characteristic of said acousto-electronic transducer.

* * * * *